US009432783B2

(12) United States Patent
Munk

(10) Patent No.: US 9,432,783 B2
(45) Date of Patent: Aug. 30, 2016

(54) METHOD OF FITTING A HEARING DEVICE

(71) Applicant: Oticon A/S, Smørum (DK)

(72) Inventor: Steen Michael Munk, Smørum (DK)

(73) Assignee: OTICON A/S, Smorum (DK)

( * ) Notice: Subject to any disclaimer, the term of this patent is extended or adjusted under 35 U.S.C. 154(b) by 562 days.

(21) Appl. No.: 13/875,034

(22) Filed: May 1, 2013

(65) Prior Publication Data

US 2013/0294610 A1 Nov. 7, 2013

Related U.S. Application Data

(60) Provisional application No. 61/641,312, filed on May 2, 2012.

(30) Foreign Application Priority Data

May 2, 2012 (EP) ..... 12166326

(51) Int. Cl.
*H04R 29/00* (2006.01)
*H04R 25/00* (2006.01)

(52) U.S. Cl.
CPC ..... *H04R 25/70* (2013.01); *H04R 25/453* (2013.01)

(58) Field of Classification Search
CPC .... H04R 25/70; H04R 25/453; H04R 25/45; H04R 25/50; H04R 3/02
USPC ..... 381/60, 317, 318
See application file for complete search history.

(56) References Cited

U.S. PATENT DOCUMENTS

| | | | | |
|---|---|---|---|---|
| 2003/0161492 | A1* | 8/2003 | Miller | H04R 25/453 381/326 |
| 2005/0226447 | A1 | 10/2005 | Miller, III | |
| 2006/0285709 | A1 | 12/2006 | Barthel | |
| 2008/0031479 | A1 | 2/2008 | Sorgel | |
| 2010/0166198 | A1* | 7/2010 | Perman | H04R 25/453 381/60 |

FOREIGN PATENT DOCUMENTS

| | | |
|---|---|---|
| EP | 1 310 138 B1 | 9/2006 |
| EP | 1 708 544 A1 | 10/2006 |
| EP | 1 737 270 A1 | 12/2006 |
| EP | 1 885 158 A2 | 2/2008 |

* cited by examiner

*Primary Examiner* — Vivian Chin
*Assistant Examiner* — Douglas Suthers
(74) *Attorney, Agent, or Firm* — Birch, Stewart, Kolasch & Birch, LLP

(57) ABSTRACT

The invention relates to a method for determining an estimated transfer function of an acoustic feedback path during fitting of a hearing device, which receives acoustic signals from an individual's surroundings, modifies the acoustic signals electronically and transmits the modified acoustic signals into the individual's ear or ear canal. In order to save resources in the hearing device, the hearing device reuses a start-up jingle for determining an estimated transfer function during a fitting session upon reception of a predefined message from a fitting apparatus.

21 Claims, 3 Drawing Sheets

METHOD OF FITTING A HEARING DEVICE

TECHNICAL FIELD

The present invention relates to a method for fitting a hearing device. More specifically, the present invention relates to determining an estimated transfer function of an acoustic feedback path during fitting of a hearing device, such as e.g. a hearing aid or a listening device, which receives acoustic signals from an individual's surroundings, modifies the acoustic signals electronically and transmits the modified acoustic signals into the individual's ear or ear canal.

The invention may e.g. be useful in applications such as compensating for a hearing-impaired individual's loss of hearing capability, augmenting a normal-hearing individual's hearing capability or protecting an individual's hearing capability.

BACKGROUND ART

Many known hearing devices must be adapted or fitted to the particular individual who is to be using the hearing device, i.e. the user. Such fitting may be necessary in order to account for e.g. differing hearing capabilities and/or differing anatomic features of the ear, and typically comprises setting a maximum gain for the hearing device in order to prevent feedback-generated oscillations during use of the hearing device. Fitting is typically performed by a hearing-care professional (HCP or "dispenser") by means of a fitting apparatus connected to the hearing device.

Patent application EP 1 708 544 discloses a system and a method for measuring vent effects in a hearing aid. During a self-test performed at the beginning of a fitting session, the hearing aid generates an electric tone signal in an electric signal path between the hearing-aid microphone and the hearing-aid loudspeaker, picks up the acoustic feedback from the loudspeaker to the microphone, and generates a correlation signal based on a comparison between the electric tone signal and the acoustic feedback. The hearing aid then calculates acoustic properties of the vent based on the correlation signal. If the calculated acoustic properties deviate from previously stored properties, the HCP is informed and may then e.g. modify the length or the diameter of the vent or lower the gain of the hearing aid.

Patent EP 1 310 138 B1 discloses a hearing aid in which the signal path between the microphone and the loudspeaker is blocked during a comfort delay period after start-up of the hearing aid in order to avoid feedback-generated oscillations during insertion of the hearing aid into the ear. During the comfort delay period, the hearing aid generates an acoustic signal in order to notify the user that the hearing aid is switched on and is operative.

DISCLOSURE OF INVENTION

It is an object of the present invention to provide improvements of the above mentioned methods, apparatus and systems.

These and other objects of the invention are achieved by the invention defined in the accompanying independent claims and as explained in the following description. Further objects of the invention are achieved by the embodiments defined in the dependent claims and in the detailed description of the invention.

In the present context, a "hearing device" refers to a device, such as e.g. a hearing aid or an active ear-protection device, which is adapted to improve, augment and/or protect the hearing capability of an individual by receiving acoustic signals from the individual's surroundings, generating corresponding audio signals, modifying the audio signals and providing the modified audio signals as audible signals to at least one of the individual's ears. Such audible signals may e.g. be provided in the form of acoustic signals radiated into the individual's outer ears, acoustic signals transferred as mechanical vibrations to the individual's inner ears through the bone structure of the individual's head and/or electric signals transferred directly or indirectly to the cochlear nerve of the individual. The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, etc. More generally, a hearing device comprises an input transducer for receiving an acoustic signal from an individual's surroundings and providing a corresponding input audio signal, a signal processing circuit for processing the input audio signal and an output transducer for providing an audible signal to the individual in dependence on the processed audio signal.

A "hearing system" refers to a system comprising one or two hearing devices, and a "binaural hearing system" refers to a system comprising one or two hearing devices and being adapted to provide audible signals to both of the individual's ears with some degree of correlation. Hearing systems or binaural hearing systems may further comprise "auxiliary devices", which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired individual's loss of hearing capability, augmenting a normal-hearing individual's hearing capability and/or protecting an individual's hearing capability.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

MODE(S) FOR CARRYING OUT THE INVENTION

Figure 1:
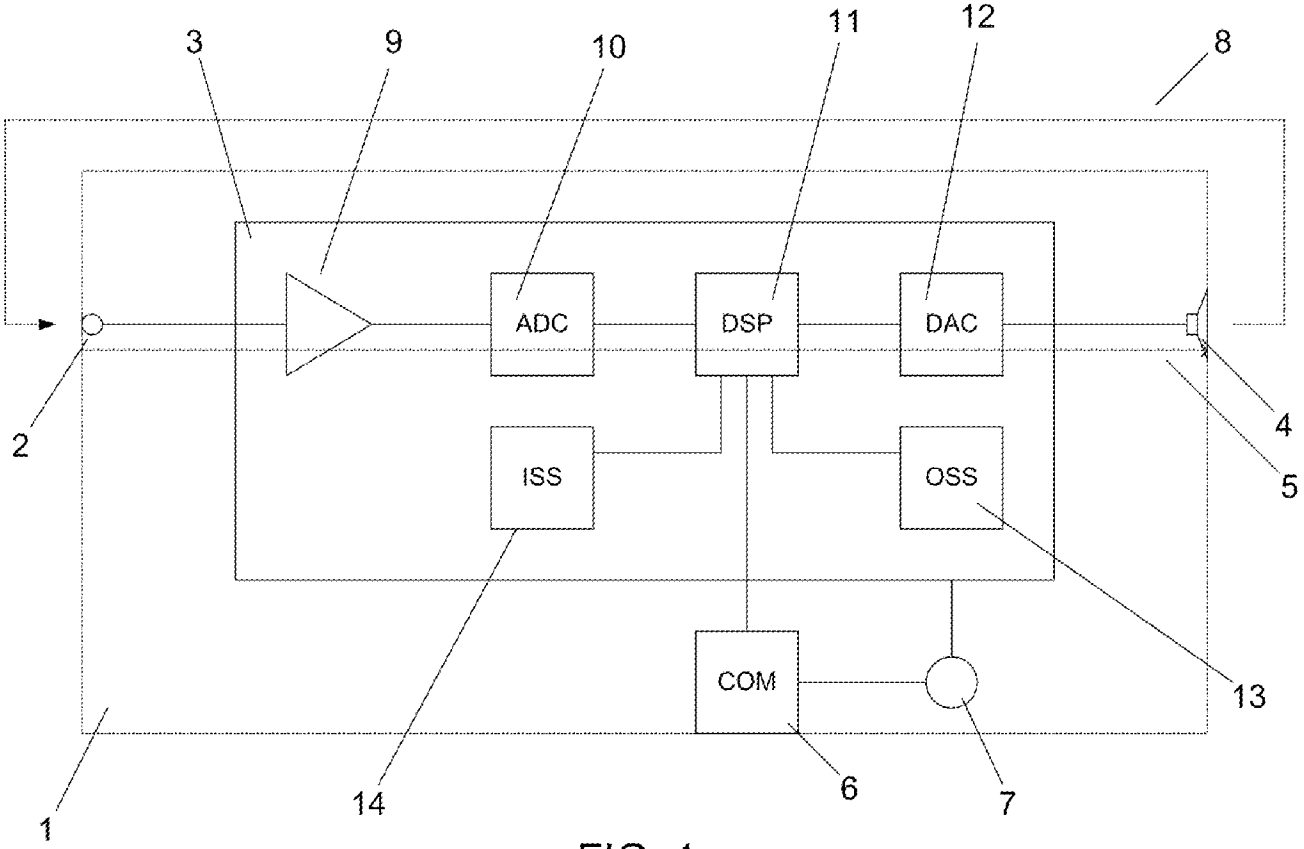
FIG. 1 shows a hearing device according to an embodiment of the invention.

FIG. 1 shows a hearing device 1, e.g. a hearing aid or an active ear-protection device, comprising a microphone 2, a signal processor 3 and a loudspeaker 4 connected to form an electronic signal path 5. The hearing device 1 further comprises a communication interface 6 and a battery 7 for powering the signal processor 3 and the communication interface 6. The hearing device 1 is adapted to be arranged at or in an ear of a user. The microphone 2 is arranged to receive an acoustic input signal from the user's surroundings and is adapted to provide a corresponding microphone signal to the signal processor 3, which is adapted to modify the microphone signal in accordance with the purpose of the hearing device 1, i.e. to improve, augment and/or protect the hearing capability of the user. The signal processor 3 is adapted to provide the modified microphone signal to the loudspeaker 4, which is adapted and arranged to transmit a corresponding acoustic output signal into the user's ear.

The electronic signal path 5 has an acoustic gain, which is typically both time- and frequency-dependent and is defined as the ratio between the acoustic output signal and the acoustic input signal. A portion of the acoustic output signal travels to the microphone 2 via an acoustic feedback path 8. The electronic signal path 5 and the acoustic feedback path 8 thus form a loop, in which oscillations may occur, depending on the loop gain. Such oscillations are typically perceived as annoying howling or whistling sounds or as a decreased sound quality. The transfer function of the acoustic feedback path 8 depends on properties of the hearing device 1 itself and on properties of the immediate environment of the hearing device 1, and the loop gain is thus difficult to control or predict. For instance, the transfer function typically changes radically when the hearing device 1 is inserted into or removed from the ear or when objects, such as a hand or a telephone, are moved close to the ear with the inserted hearing device 1.

The signal processor 3 is further connected to receive and transmit messages from/to the communication interface 6. Such messages may comprise e.g. mode commands to change the operating mode of the hearing device 1, settings to control the signal processing in the signal processor 3 and/or audio signals. The communication interface 6 may communicate with other apparatus, such as e.g. a remote control (not shown) or a fitting apparatus 20 (see FIG. 2), by wire or wirelessly, e.g. by means of optical or radio frequency signals.

The signal processor 3 may preferably comprise a preamplifier 9, a digitiser 10, a digital signal processor (DSP) 11 and a digital-to-analog converter (DAC) 12, such as e.g. a pulse-width modulator, and may thus be able to process the microphone signal digitally. The preamplifier 9 is adapted to amplify the microphone signal and provide the amplified signal to the digitiser 10, which is adapted to digitise the amplified signal and provide the digitised signal to the DSP 11. The DSP 11 is adapted to process the digitised signal and provide the processed signal to the DAC 12, which is adapted to convert it into an analog signal, such as e.g. a pulse-width-modulated signal, in the modified microphone signal provided to the loudspeaker 4.

The signal processor 3 may further comprise an output signal storage 13 in which one or more audio signals may be stored. Audio signals may be stored as waveform signals or in compressed form, e.g. as commands for a signal generator (not shown) which may also be comprised in the signal processor 3 or the DSP 11. The signal processor 3 may further comprise an input signal storage 14 in which one or more microphone signals or digitised signals may be stored. Microphone signals or digitised signals may be stored as waveform signals or in compressed form, e.g. as an output from a signal analyser (not shown) which may also be comprised in the signal processor 3 or the DSP 11.

Various methods are known in the art for suppressing or preventing feedback-generated oscillations in hearing devices. Such methods comprise e.g. adaptive feedback cancelling, frequency shifting, notch-filtering and gain limiting, and any combination of such methods may be implemented in the signal processor 3 or the DSP 11. The performance of such methods may generally be improved by applying knowledge about the current value of the transfer function of the acoustic feedback path 8. For instance, an adaptive feedback canceller or an adaptive feedback cancelling system may require some time to estimate the current value of the transfer function of the acoustic feedback path 8, and this time may be shortened by using a value obtained by other means as a first estimate.

Figure 2:
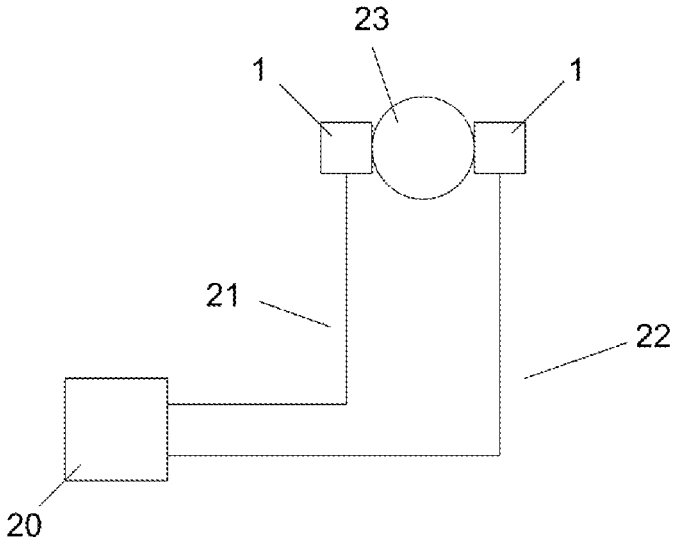
FIG. 2 shows a system according to an embodiment of the invention.

Furthermore, determination of feedback-related settings in the hearing device 1, such as e.g. a maximum gain limit and/or the amount of frequency shift, may be improved by applying knowledge about typical values of the transfer function of the acoustic feedback path 8. Such settings may be determined and transferred in messages from a fitting apparatus 20 to the hearing device 1 during a fitting session as shown in FIG. 2. The fitting apparatus 20, which may e.g. comprise an appropriately programmed conventional computer with a display, a keyboard, a mouse and an interface unit (not shown), is connected to the communication interface 6 of the hearing device 1—or of each hearing device 1 in a binaural hearing system—via the interface unit and a wired or wireless connection 21, 22. The fitting apparatus 20 is typically controlled by an HCP, who determines appropriate settings for the hearing device or devices 1 in dependence on e.g. audiograms and/or other information about the user 23.

Figure 3:
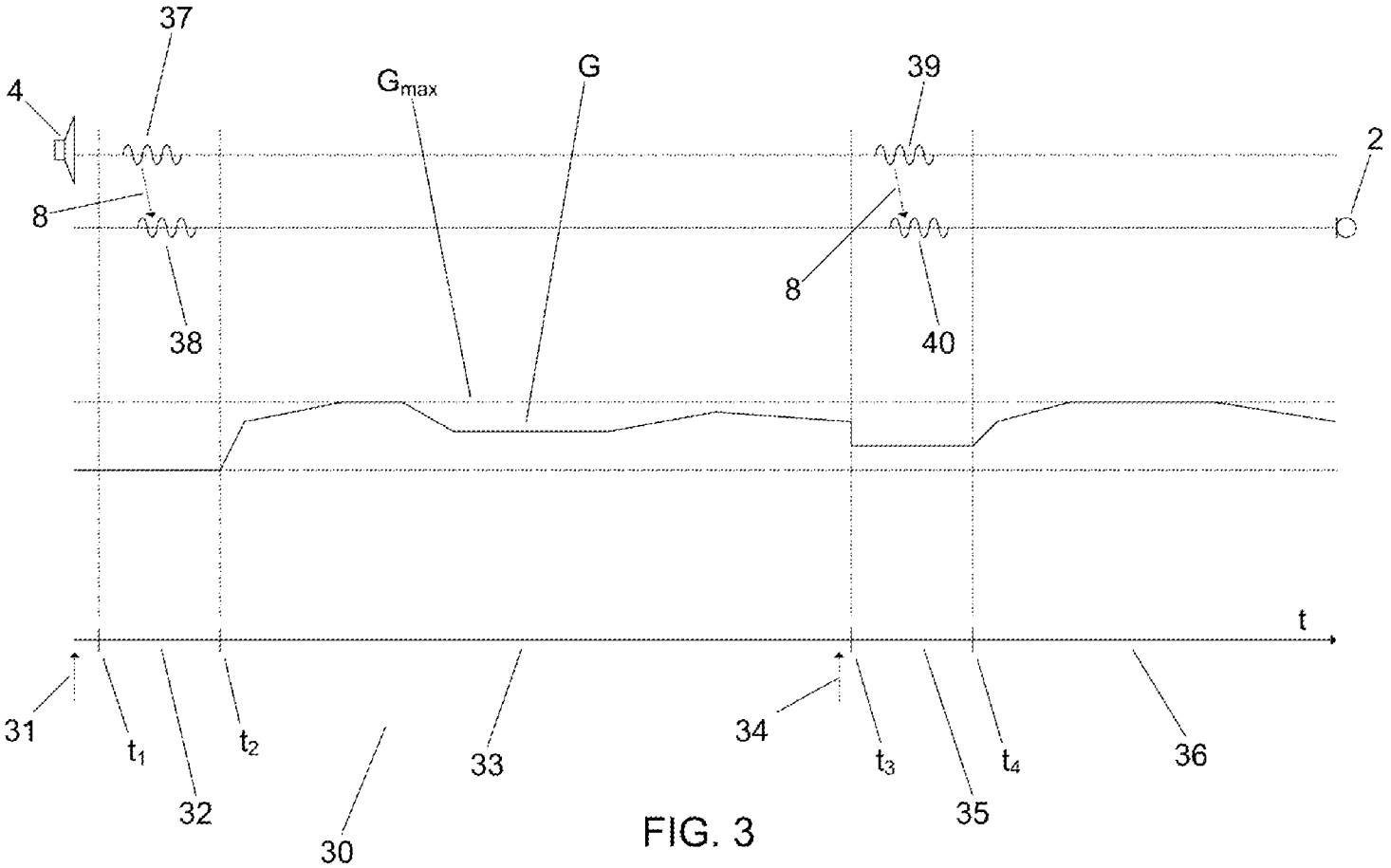
FIG. 3 illustrates a method according to an embodiment of the invention.

FIG. 3 illustrates a method according to the invention, which may be implemented in the hearing device or devices 1 of FIGS. 1 and 2 and/or in the fitting apparatus of FIG. 2. The timeline 30 illustrates the progressing time t. At time $t_1$, on start-up 31 of the hearing device 1, a start-up period 32 begins, and it ends at time $t_2$. The start-up period 32 precedes a first portion 33 of a user-mode period which begins at time $t_2$. At time $t_3$, on reception of a predetermined message 34 from the fitting apparatus 20 in the communication interface 6 of the hearing device 1, the first portion 33 of the user-mode period ends and a test period 35 begins. The test period 35 ends at time $t_4$, whereafter a second portion 36 of the user-mode period begins.

The test period 35 thus interrupts the user-mode period 33, 36. The user-mode period 33, 36 continues till shutdown of the hearing device 1, possibly interrupted by further test periods 35. Any of the start-up period 32, the user period 33, 36 and/or the test period 35 may be interrupted for other purposes, and these time periods, 32, 33, 35, 36 need also not be adjacent to each other.

During the user-mode period 33, 36, the hearing device 1 operates in a user mode in which the hearing device 1 controls the acoustic gain G primarily as a function of levels and content of the received microphone signal. The curve G shows an example of how the acoustic gain G may vary over time. Typically, the acoustic gain G is increased in quiet environments and decreased in noisy or loud environments. The hearing device 1 may have a maximum gain setting $G_{max}$, which limits the acoustic gain G in order to prevent feedback-generated oscillations during normal use of the hearing device 1.

During insertion of the hearing device 1 into the user's ear, the transfer function of feedback path 8 may obtain values that would cause feedback-generated oscillations even with an acoustic gain G not exceeding the maximum gain setting $G_{max}$. In order to prevent such oscillations during the insertion, the hearing device 1 operates in a gain-reduced mode during the start-up period 32. In the gain-reduced mode, the acoustic gain G is lower than in the user-mode. For instance, the electronic signal path 5 may be blocked completely, or the acoustic gain G may be set to a value e.g. 6 dB, 10 dB, 20 dB or 30 dB lower than the maximum value of the acoustic gain G or than the maximum gain setting $G_{max}$. The amount of lowering is preferably selected such that it effectively prevents feedback-generated oscillations in the hearing device 1 during the start-up period 32.

Since the acoustic gain G is reduced during the start-up period 32, the hearing device 1 does not provide the normal amplification of environment sounds, and the user might thus not be aware that the hearing device 1 is actually turned on. In order to signal the status of the hearing device 1 as early as possible, the hearing device 1 provides within the start-up period 32 a first predetermined audio signal 37, e.g. a start-up jingle, and transmits it via the loudspeaker 4. A portion of the transmitted acoustic signal 37 reaches the microphone 2 through the acoustic feedback path 8 as a first acoustic feedback signal 38. The microphone 2 may receive and convert the first acoustic feedback signal 38 into a corresponding first microphone signal, and the hearing device 1 may determine a first estimated transfer function of the acoustic feedback path 8 by comparing the first microphone signal and the first predetermined audio signal 37. The comparison may e.g. be made by determining the correlation between the signals at multiple frequencies. The hearing device 1 may further store the first microphone signal in the input signal storage 14 from which the hearing device 1 may retrieve it for subsequent use. The first predetermined audio signal 37 is preferably composed of a polyphonic sequence of tones and/or tonal sweeps with harmonic relations such that it provides a pleasant experience to the user.

The hearing device 1 may use the first estimated transfer function to determine initial settings for suppressing or preventing feedback-generated oscillations. The first estimated transfer function may e.g. be used as a first estimate in an adaptive feedback canceller (not shown) in the hearing device 1. In the user mode, the hearing device 1 may further control the acoustic gain G in dependence on the first estimated transfer function. Alternatively or additionally, the hearing device 1 may compare the first estimated transfer function to a previously saved transfer function, based on the comparison determine whether the insertion of the hearing device 1—and/or an ear-mould or earplug hereof—is completed, and optionally repeat the transmission of the first predetermined audio signal 37 and the determination of the first estimated transfer function until a comparison with the previously saved transfer function indicates that the insertion is completed. Alternatively or additionally, the hearing device 1 may compare the first estimated transfer function to a previously saved transfer function, and based on the comparison determine whether the acoustic feedback path has undergone long-term changes, e.g. due to blocking of a vent in the hearing device 1 or due to physical changes in the ear canal of the user—e.g. the growing of a child's ear. Such conditions may be signalled to the user by means of an appropriate acoustic warning signal. The first predetermined audio signal 37 as well as any warning signals may be stored in the output signal storage 13, e.g. during production of the hearing device 1 and/or during a fitting session, and the hearing device 1 may retrieve them therefrom when required. Instead of comparing estimated transfer functions, the hearing device 1 may for the same purposes and with the same benefits compare stored microphone signals.

The hearing device 1 is fitted to the user in a fitting session in which the hearing device 1 is connected to the fitting apparatus 20 as shown in FIG. 2. During the fitting session, the fitting apparatus 20 transmits various messages to the hearing device 1, in order to e.g. prepare the hearing device 1 for fitting, request data from the hearing device 1, initiate measurements within the hearing device 1 and/or set parameters in the hearing device 1. The hearing device 1 receives the messages in the communication interface 6 and responds according to their content.

On receiving a predetermined message 34 that directly or indirectly indicates that a measurement of the acoustic feedback path 8 should be conducted, the hearing device 1 temporarily invokes the test period 35. Within the test period 35, the hearing device 1 provides a second predetermined audio signal 39, e.g. the start-up jingle, and transmits it via the loudspeaker 4. A portion of the transmitted acoustic signal 39 reaches the microphone 2 through the acoustic feedback path 8 as a second acoustic feedback signal 40. The microphone 2 receives and converts the second acoustic feedback signal 40 into a corresponding second microphone signal, and the hearing device 1 determines a second estimated transfer function of the acoustic feedback path 8 by comparing the second microphone signal and the first and/or the second predetermined audio signal 37, 39. The hearing device 1 may further store the second microphone signal in the input signal storage 14 for subsequent use, and in this case, determining the second estimated transfer function of the acoustic feedback path 8 may be performed by the fitting apparatus 20 instead of the hearing device 1. The hearing device 1 communicates the second estimated transfer function and/or the second microphone signal to the fitting apparatus 20, which may compute the second estimated transfer function and/or display it to the HCP.

The hearing device 1 and/or the fitting apparatus 20 may perform one or more of the comparisons performed by the hearing device 1 upon start-up as described above, this time based on the second estimated transfer function and/or the second microphone signal. Instead of comparing estimated transfer functions, the hearing device 1 and/or the fitting apparatus 20 may compare stored microphone signals in order to arrive at the same conclusions.

Additionally or alternatively, the hearing device 1 may determine the first and/or the second estimated transfer function of the acoustic feedback path 8 by means of an adaptive feedback canceller (not shown) comprised in the hearing device 1. The adaptive feedback canceller may determine the estimate(s) by comparing the first and/or second microphone signal with the first and/or second predetermined audio signal 37, 39.

The HCP and/or the fitting apparatus 20 may use the second estimated transfer function and/or the results of comparison with previously stored transfer functions or microphone signals to determine settings for the hearing device 1. Such settings may comprise settings related to feedback suppression, such as e.g. a maximum gain limit and/or the amount of frequency shift. Thus, in the user mode, the hearing device 1 may eventually control the acoustic gain G in dependence on the second estimated transfer function.

The fitting apparatus 20 preferably transmits the predetermined message 34 automatically, i.e. without intervention of the HCP, in reaction to one or more predefined events during the fitting session. Such events may e.g. be detection of a connection between the fitting apparatus 20 and the hearing device 1, start-up of a predefined program in the fitting apparatus 20 and/or initiation of a predefined part of the fitting procedure in the fitting apparatus 20.

The hearing device 1 may operate in the noise-reduced mode during the test period 35 in order to allow for a more precise determination of the second estimated transfer function. The gain reduction in the test period 35 may be less than in the start-up period 32, since at this time, the hearing device 1 should already be properly inserted into the user's ear, and thus, large variations of the acoustic feedback path 8 are unlikely to occur.

The hearing device 1 may invoke the test period 35 by restarting itself, such that a second start-up period 32 forms the test period 35, or it may invoke the test period 35 as a period independent from the start-up period 32.

The second predetermined audio signal 39 is substantially identical to the first predetermined audio signal 37. In the present context, substantial identity implies that the signals 37, 39 are derived from the same stored audio signal. This allows saving resources in the hearing device 1. Preferably, the signals 37, 39 are so identical that the user will perceive them as identical. This aids in giving the user the impression that the hearing device 1 functions in a known way in the fitting session.

The first and second predetermined audio signals 37, 39 preferably comprise a sequence of varying tones, and the hearing device 1 and/or the fitting apparatus 20 may determine the first and/or the second estimated transfer function at multiple frequencies corresponding to the tones. This further allows for providing a pleasant signal to the user.

The first and second predetermined audio signals 37, 39 preferably, additionally or alternatively, comprise one or more frequency sweeps, and the hearing device 1 and/or the fitting apparatus 20 may determine the first and/or the second estimated transfer function across one or more continuous frequency ranges.

The first and second predetermined audio signals 37, 39 are preferably polyphonic in order to allow a relatively short duration of the start-up period 32 and/or the test period 35.

Composing the first and second predetermined audio signals 37, 39 of a polyphonic sequence of tones and/or tonal sweeps, preferably with harmonic relations, increases the probability of providing a pleasant experience to the user and thus increases the probability of achieving a good fitting result.

The method may be implemented in the hearing device 1 and/or in a system comprising a fitting apparatus 20 and a hearing device 1.

The signal processor 3 is preferably implemented mainly as digital circuits operating in the discrete time domain, but any or all parts hereof may alternatively be implemented as analog circuits operating in the continuous time domain. Digital functional blocks of the signal processor 3 and/or of the communication interface 6 may be implemented in any suitable combination of hardware, firmware and software and/or in any suitable combination of hardware units. Furthermore, any single hardware unit may execute the operations of several functional blocks sequentially, in parallel or in interleaved sequence and/or in any suitable combination thereof.

Further modifications obvious to the skilled person may be made to the disclosed method, system, apparatus and/or device without deviating from the scope of the invention. Within this description, any such modifications are mentioned in a non-limiting way. The possible modifications below are mentioned as examples hereof.

Some preferred embodiments have been described in the foregoing, but it should be stressed that the invention is not limited to these, but may be embodied in other ways within the subject-matter defined in the following claims. For example, the features of the described embodiments may be combined arbitrarily, e.g. in order to adapt the system, the apparatus, the devices and/or the method according to the invention to specific requirements.

It is further intended that the structural features of the system, apparatus and/or devices described above, in the detailed description of 'mode(s) for carrying out the invention' and in the claims can be combined with the methods, when appropriately substituted by a corresponding process. Embodiments of the methods have the same advantages as the corresponding systems and/or devices.

Any reference numerals and names in the claims are intended to be non-limiting for their scope.

The invention claimed is:

1. A method of fitting a hearing device to an individual, the hearing device comprising a communication interface, a microphone, a signal processor and a loudspeaker connected in series to form an electronic signal path having an acoustic gain, the loudspeaker and the microphone being arranged such that an acoustic feedback path exists from the loudspeaker to the microphone, the method comprising:

during a user-mode period, operating the hearing device in a user mode in which the acoustic gain is non-zero;

during a start-up period that precedes the user-mode period and starts on start-up of the hearing device, operating the hearing device in a gain-reduced mode in which the acoustic gain is lower than in the user-mode and thus effectively prevents feedback-generated oscillations in the hearing device;

within the start-up period, providing a first predetermined audio signal and transmitting it via the loudspeaker such that a portion thereof reaches the microphone through the acoustic feedback path as a first acoustic feedback signal, and determining with the signal processor a first estimated transfer function of the acoustic feedback path based on the first acoustic feedback signal and the first predetermined audio signal;

receiving in the communication interface a predetermined message from a fitting apparatus;

interrupting the user-mode period with a test-period on receiving the predetermined message and continuing the user-mode period at the conclusion of the test-period;

during the test-period, providing a second predetermined audio signal substantially identical to the first predetermined audio signal and transmitting it via the loudspeaker such that a portion thereof reaches the microphone through the acoustic feedback path as a second acoustic feedback signal;

receiving in the microphone the second acoustic feedback signal and providing a corresponding second microphone signal; and determining with the signal processor a second estimated transfer function of the acoustic feedback path in dependence on the second microphone signal and at least one of the first predetermined audio signal and the second predetermined audio signal.

2. Method according to claim 1 and further comprising:

during the test period, operating the hearing device in the gain-reduced mode.

3. Method according to claim 2, wherein upon reception of the predetermined message the acoustic gain of the test period is set to match the acoustic gain of the start-up period.

4. Method according to claim 3, wherein the acoustic gain is zero during the start-up period and the test period.

5. Method according to claim 3 and further comprising:

receiving in the microphone the first acoustic feedback signal and providing a corresponding first microphone signal;

determining a first estimated transfer function of the acoustic feedback path in dependence on the first microphone signal and the first predetermined audio signal.

6. Method according to claim 3, further comprising:

in the user mode, controlling the acoustic gain in dependence on at least one of the first estimated transfer function and the second estimated transfer function.

7. Method according to claim 2, wherein the acoustic gain is zero during at least one of the start-up period and the test period.

8. Method according to claim 2 and further comprising:

receiving in the microphone the first acoustic feedback signal and providing a corresponding first microphone signal;

determining a first estimated transfer function of the acoustic feedback path in dependence on the first microphone signal and the first predetermined audio signal.

9. Method according to claim 2, further comprising:

in the user mode, controlling the acoustic gain in dependence on at least one of the first estimated transfer function and the second estimated transfer function.

10. Method according to claim 1, wherein the acoustic gain is zero during at least one of the start-up period and the test period.

11. Method according to claim 10 and further comprising:

receiving in the microphone the first acoustic feedback signal and providing a corresponding first microphone signal;

determining a first estimated transfer function of the acoustic feedback path in dependence on the first microphone signal and the first predetermined audio signal.

12. Method according to claim 1, further comprising:

receiving in the microphone the first acoustic feedback signal and providing a corresponding first microphone signal.

13. Method according to claim 1, further comprising:

in the user mode, controlling the acoustic gain in dependence on at least one of the first estimated transfer function and the second estimated transfer function.

14. Method according to claim 1 wherein the first and the second predetermined audio signals comprise a sequence of varying tones.

15. Method according to claim 1 wherein the first and the second predetermined audio signals comprise one or more frequency sweeps.

16. Method according to claim 1 wherein the first and the second predetermined audio signals are polyphonic.

17. Method according to claim 1, further comprising:

in the fitting apparatus, determining one or more settings for the hearing device in dependence on at least one of the first estimated transfer function and the second estimated transfer function; and transmitting the one or more settings from the fitting apparatus to the hearing device.

18. Method according to claim 17 wherein the one or more settings comprise a setting for maximum gain.

19. A hearing device, comprising:

a communication interface;

a microphone;

a signal processor; and a loudspeaker connected in series to form an electronic signal path having an acoustic gain, the loudspeaker and the microphone being arranged such that an acoustic feedback path exists from the loudspeaker to the microphone, wherein the signal processor is configured to execute a method including during a user-mode period, operating the hearing device in a user mode in which the acoustic gain is non-zero;

during a start-up period that precedes the user-mode period and starts on start-up of the hearing device, operating the hearing device in a gain-reduced mode in which the acoustic gain is lower than in the user-mode and thus effectively prevents feedback-generated oscillations in the hearing device;

within the start-up period, providing a first predetermined audio signal and transmitting it via the loudspeaker such that a portion thereof reaches the microphone through the acoustic feedback path as a first acoustic feedback signal, and determining a first estimated transfer function of the acoustic feedback path based on the first acoustic feedback signal and the first predetermined audio signal;

receiving in the communication interface a predetermined message from a fitting apparatus;

interrupting the user-mode period with a test-period on receiving the predetermined message and continuing the user-mode period at the conclusion of the test-period;

during the test-period, providing a second predetermined audio signal substantially identical to the first predetermined audio signal and transmitting it via the loudspeaker such that a portion thereof reaches the microphone through the acoustic feedback path as a second acoustic feedback signal;

receiving in the microphone the second acoustic feedback signal and providing a corresponding second microphone signal; and determining a second estimated transfer function of the acoustic feedback path in dependence on the second microphone signal and at least one of the first predetermined audio signal and the second predetermined audio signal.

20. The hearing device according to claim 19, comprising a hearing aid.

21. A system, comprising:

the hearing device according to claim 19; and the fitting apparatus.

* * * * *